US007352354B2

(12) United States Patent
Ishige

(10) Patent No.: US 7,352,354 B2
(45) Date of Patent: Apr. 1, 2008

(54) PARTICLE MOVING TYPE DISPLAY DEVICE

(75) Inventor: Koichi Ishige, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 489 days.

(21) Appl. No.: 11/081,741

(22) Filed: Mar. 17, 2005

(65) Prior Publication Data

US 2005/0206995 A1 Sep. 22, 2005

(30) Foreign Application Priority Data

Mar. 19, 2004 (JP) ..... 2004-081695

(51) Int. Cl.
*G09G 3/34* (2006.01)

(52) U.S. Cl. ..... 345/107; 345/84

(58) Field of Classification Search ..... 345/72–88, 345/90–107; 359/252, 296
See application file for complete search history.

(56) References Cited

U.S. PATENT DOCUMENTS 3,892,568 A 7/1975 Ota ..... 96/1.3
6,639,580 B1 10/2003 Kishi et al. ..... 345/107
6,897,996 B2 5/2005 Ikeda et al. ..... 359/296
7,038,670 B2 * 5/2006 Liang et al. ..... 345/204
7,075,502 B1 * 7/2006 Drzaic et al. ..... 345/55
7,224,510 B2 * 5/2007 Kitano et al. ..... 359/296
2003/0231162 A1 * 12/2003 Kishi ..... 345/107
2004/0263947 A1 * 12/2004 Drzaic et al. ..... 359/296
2005/0012981 A1 * 1/2005 Miura et al. ..... 359/296
2005/0052402 A1 * 3/2005 Kitano et al. ..... 345/102

* cited by examiner

*Primary Examiner*—Nitin I. Patel
(74) *Attorney, Agent, or Firm*—Fitzpatrick, Cella, Harper & Scinto

(57) ABSTRACT

A display device includes a transparent first boundary member having a display side, a second boundary member disposed at a predetermined distance from the first boundary member, and partition walls disposed between the first and second boundary members and forming an enclosed gap therebetween. Two types of charged particles and a dispersion medium are disposed in the gap between the first and second boundary members, with the two types of changing particles having different charging polarities and optical characteristics. Also included are first and second electrodes to which voltages are applied and which move the charged particles in the gap to form a display, with the first electrode disposed proximate to the first or second boundary members and the second electrode disposed proximate to the portion walls, and a light reflection member on the second boundary member for reflecting light to the first boundary member.

22 Claims, 10 Drawing Sheets

PARTICLE MOVING TYPE DISPLAY DEVICE

BACKGROUND OF THE INVENTION

1. Field of the Invention

The present invention relates to a particle moving type display device which moves charged particles to thereby perform display.

2. Description of the Related Art

In recent years, a particle moving type display device has been proposed which moves charged particles to thereby perform display. As one example of the particle moving type display device, there is a device which disperses charged migration particles in an insulating liquid, applies an electric field to the charged migration particles to thereby move the charged migration particles, and accordingly performs display.

Moreover, as an electric migration display element for use in the electric migration display device, an element has been proposed in U.S. Pat. No. 3,892,568 comprising: a pair of substrates disposed at a predetermined gap; a dispersion medium which is disposed in the gap between the substrates and in which the charged migration particles are dispersed; and a pair of electrodes arranged in the vicinity of the dispersion medium.

FIG. 10 is a diagram showing a schematic constitution of a conventional electric migration display element. A space held between a pair of transparent electrodes 22*a*, 22*b* formed on a pair of transparent substrates 21*a*, 21*b*, respectively, is charged with a liquid medium 25 in which particles 23, 24 having different optical reflection characteristics (optical characteristics) and charge polarities (charging characteristics) are dispersed.

Moreover, when voltages are applied to the respective transparent electrodes 22*a*, 22*b* from a power supply 26 via a switch 27 capable of switching the polarity, the particles 23, 24 are selectively collected in the vicinity of the respective electrodes to thereby perform display.

Furthermore, as another conventional example of an electric migration display element, as described in U.S. Pat. No. 6,639,580, a reflection plate is disposed on one substrate 21*b*. Moreover, for example, when the liquid medium 25 is charged with black particles to perform black display, the black particles are moved toward one substrate 21*b*. On the other hand, to perform white display, the black particles are moved sideways, incident light is reflected by the reflection plate, and the reflected light from the reflection plate is directly visually recognized.

However, in this conventional electric migration display device, layers of the particles 23, 24 having different optical characteristics are superimposed on each other in a vertical direction in a case where the electric migration display device (electric migration display element) is seen, for example, from above one transparent substrate 21*a*. Therefore, to obtain sufficient brightness (contrast), an amount of the particles 23, 24 needs to be sufficiently increased in such a manner to make a lower particle layer invisible.

If the particles have a property of completely reflecting or absorbing the light, the light is completely screened by the particles, and does not leak to the lower layer. However, in reality, even the particles having any property transmit the light to a certain degree. Therefore, the light reaches the particles of the lower layer, and reflects there, and the lower-layer particles are seen through.

Especially, white particles of the following materials are used, but there is not any particle having a great light screening effect in the present situations. When a light screening ratio (ratio of transmitted light intensity with respect to incident light intensity) of white particles is small, a large part of the light leaking to the lower layer is absorbed by black particles. As a result, bright white display is not obtained.

Therefore, when the black particles 24 and the white particles 23 are used as particles having different optical characteristics, an amount of the white particles 23 needs to be increased in order to obtain sufficiently bright white display. However, when the amount of the white particles 23 is increased in this manner, a charged particle amount in the liquid medium (dispersion liquid) increases, and therefore an electric field screening effect by the charged particles at a voltage application time increases. Therefore, when the electric field screening effect increases in this manner, a response speed of the electric migration display element drops in a case where a driving voltage is equal. Therefore, the driving voltage needs to rise in order to increase the response speed. That is, in a case where the amount of the white particles 23 is increased in order to obtain sufficient brightness (contrast), the driving voltage needs to be increased in order to compensate for the drop of the response speed.

On the other hand, in a case where the reflected light from the reflection plate is directly visually recognized to thereby perform white display, with a usual reflection plate (regular reflection plate) having a low directivity, the sufficient brightness (contrast) cannot be obtained, and the display glares. Therefore, a diffusion reflection plate having a high directivity, or a directive reflection plate has to be used as the reflection plate, and there is a problem that costs increase.

The present invention has been developed in view of this present situation, and one of the objects is to provide a particle moving type display device in which bright display is possible without increasing the amount of the charged particles, or the costs.

SUMMARY OF THE INVENTION

In accordance with one aspect of the invention, a display device includes a transparent first boundary member having a display side, a second boundary member disposed at a predetermined distance from the first boundary member, and partition walls disposed between the first and second boundary members and forming an enclosed gap therebetween. Two types of charged particles and a dispersion medium are disposed in the gap between the first and second boundary members, with the two types of changing particles having different charging polarities and optical characteristics. Also included are first and second electrodes to which voltages are applied and which move the charged particles in the gap to form a display, with the first electrode disposed proximate to the first or second boundary members and the second electrode disposed proximate to the portion walls, and a light reflection member on the second boundary member for reflecting light to the first boundary member.

In another aspect of the invention, a display device includes a transparent first boundary member having a display side, a second boundary member disposed at a predetermined distance from the first boundary member, and partition walls disposed between the first and second boundary members and forming an enclosed gap therebetween. Two types of charged particles and a dispersion medium are disposed in the gap between the first and second boundary members, with the two types of charging particles having different charging polarities and optical characteristics. Also included are first and second electrodes to which voltages are applied and which move the charged particles in the gap to form a display, and reflection means for reflecting transmitted light to the display side of the first boundary member.

In yet another aspect of the invention, a display device includes a transparent first boundary member having a display side, a second boundary member disposed at a predetermined distance from the boundary member, and partition walls disposed between the first and second boundary members and forming an enclosed gap therebetween. Two types of charged particles and a dispersion medium are disposed in the gap between the first and second boundary members, with the two types of charging particles having different charging polarities and optical characteristics. Also included are charged particle moving means for moving the charged particles in the gap to form a display, and a light reflection member on the second boundary member for reflecting light to the first boundary member.

DESCRIPTION OF THE EMBODIMENTS

A best mode for carrying out the present invention will be described hereinafter in detail with reference to the drawings.

Figure 1:
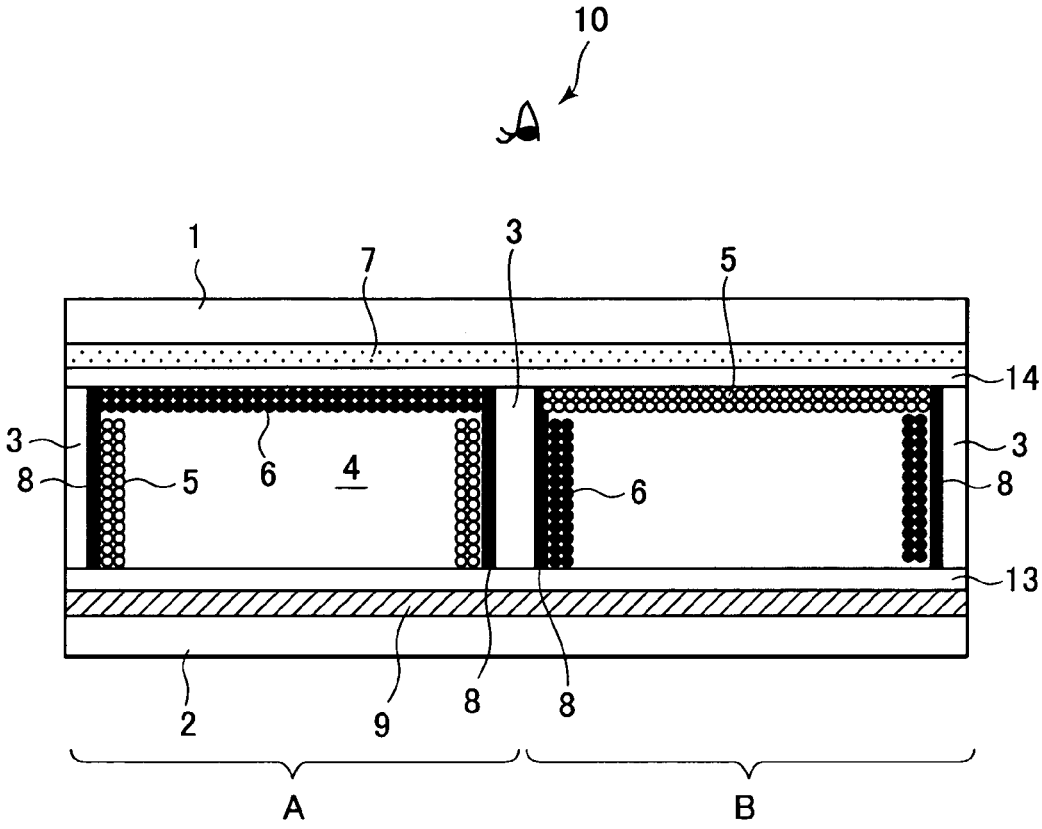
FIG. 1 is a diagram showing a schematic constitution of an electric migration display element disposed in an electric migration display device according to an embodiment of the present invention.

FIG. 1 is a diagram showing a schematic constitution of an electric migration display element disposed in an electric migration display device according to an embodiment of the present invention. In the drawing, electric migration particles are confined in small regions A and B surrounded with boundaries, and black and white display states are shown. The small regions A, B are driven independently of each other, and constitute display units, that is, pixels. In the drawing, reference numeral 1 denotes a transparent substrate which is disposed on the side seen by a user, that is, on a display face side and which constitutes a first boundary member between the small regions A, B. This will be hereinafter referred to as a first substrate or a display-side substrate. 2 denotes a substrate which is disposed at a predetermined interval from the display-side substrate 1 and which constitutes a second boundary member between the small regions A, B. This will be hereinafter referred to as a second substrate or a rear-side substrate.

Reference numeral 3 denotes partition wall, or spacers, which form boundary members between and around the pixels A, B in order to maintain a certain interval between the display-side substrate 1 and the rear-side substrate 2. 4 denotes a dispersion medium which is filled being the display-side substrate 1 and the rear-side substrate 2, and at least two types of charged particles 5, 6 are dispersed in the dispersion medium. The particles are different from each other in optical characteristics such as reflectance and color and positive/negative polarity. It is to be noted that in the present embodiment, negatively charged white particles are used as the charged particles 5 having first optical characteristics, and positively charged black particles are used as the charged particles 6 having second optical characteristics.

Reference numeral 7 denotes a first electrode disposed on the display-side substrate and having a high transmittance of visible light, 8 denotes second electrodes disposed on the side faces of the partition wall 3, and 9 denotes a reflection layer disposed on the rear-side substrate and constituting a reflection portion having a high reflectance of the visible light. It is to be noted that the second electrode 8 is divided for each pixel, and the second electrode 8 and the first electrode 7 are connected to voltage application means (not shown).

Moreover, a voltage is applied between the first electrode 7 disposed on the display-side substrate and the second electrode 8 disposed on the partition wall 3 by the voltage application means, two types of charged particles 5, 6 are moved in a display-face inner direction, distributed states are changed, and display is switched. It is to be noted that 13, 14 denote insulating layers, and electric charges are prevented from being injected into the charged particles 5, 6 from the first electrode 7 by the insulating layer 14 on the side of the first electrode.

Next, a display operation of the electric migration display element constituted in this manner will be described.

For example, when 0 V is applied to the first electrode 7, and a positive voltage is applied to the second electrode 8 in the left pixel A, as shown in the drawing, the negatively charged particles 5 gather in the vicinity of the second electrode 8, and the positively charged black particles 6 gather in the vicinity of the first electrode 7. Therefore, when an observer 10 observes the element from the display-side substrate, black particles are recognized from the observer 10, and the pixel looks black.

On the other hand, when 0 V is applied to the first electrode 7, and a negative voltage is applied to the second electrode 8 in the right pixel B, the negatively charged white particles 5 move in the vicinity of the first electrode 7, and the positively charged black particles 6 move in the vicinity of the second electrode 8. Therefore, when the observer 10 observes the element from the display-side substrate, white particles are recognized from the observer 10, and the pixel looks white.

When the white particles 5 and the black particles 6 exist on the first electrode in a mixed manner, intermediate gradation can be displayed. The display is performed, when either or both of two types of charged particles is visually recognized from the display face.

Additionally, in this case, in the pixel B, the light which has transmitted through the display-side substrate 1 and entered the layer of the white particles 5 is scattered backward by the white particles 5, and observed by the observer 10. The light contributes to the white display, and a part of the light passes through the layer of the white particles 5.

Here, a reflection layer 9 is disposed on the rear-side substrate 2 in the present embodiment, and so the light scattered forward by the white particles 5 and transmitted through the layer of the white particles 5 is thereafter reflected by the reflection layer 9, travels toward the display-side substrate, passes through the layer of the white particles 5 again, and comes out from the display face to be observed by the observer 10.

That is, in this display state, the incident light is not only reflected by the white particles 5, but also transmitted through the white particles 5 and reflected by the reflection layer 9 of the rear-side substrate 2 toward the display-side substrate 1. Therefore, brightness of the pixel is a total of a quantity of light transmitted through the display-side substrate 1 and reflected by the white particles 5, and a quantity of light transmitted through the white particles 5, reflected by the reflection layer 9 of the rear-side substrate 2, and transmitted through the white particles 5 again. Therefore, the reflectance of the light in the bright display state (white display state) can be raised by the presence of the reflection layer 9.

Consequently, the bright display is possible without increasing the amount of the white particles 5. Furthermore, the reflection layer 9 is disposed only for a purpose of reflecting leak light from the white particles 5, the leak light is scattered during passing through the particle layer, and therefore the reflection layer 9 does not require any special diffusion property or directivity. Therefore, the reflection layer 9 can be formed at low cost.

Figure 10:
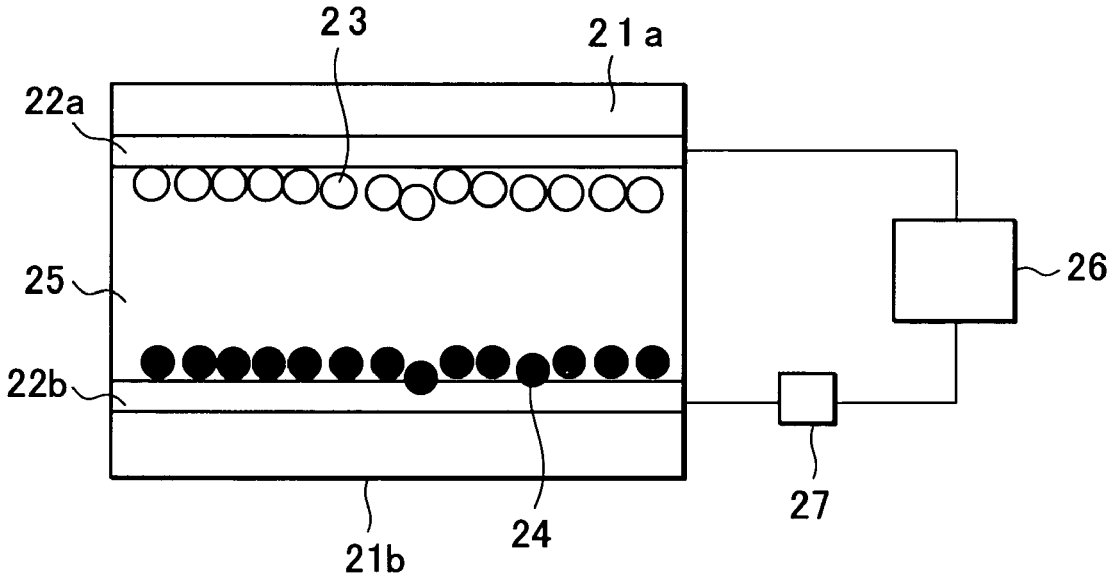
FIG. 10 is a diagram showing a schematic constitution of an electric migration display element for use in a conventional electric migration display device.

Furthermore, in the present embodiment, when the white particles 5 are moved toward the display-side substrate, the black particles 6 are moved to the vicinity of the second electrode 8. Therefore, the reflectance at a white display time can be enhanced as compared with a constitution in which the white particle layer is substantially superimposed in parallel with the black particle layer as described above with reference to FIG. 10.

As a result, the bright white display is possible without increasing the amount of the white particles 5, in other words, with a less amount of particles, and an effect of enhancement of the response speed or decrease of the driving voltage can be produced. Brighter display is therefore possible with equal particle amount.

Moreover, while the brightness of the white display state is enhanced, the black display is hardly influenced by the reflection layer in the black state, since the light-screening ability of the black particle 6 is stronger than that of the white particle 5. There is originally little light passed through the layer of the black particles 6 and leaking to the reflection face side.

It is to be noted that in the present embodiment, substantially white particles are used as the charged particles 5 having first optical characteristics, and substantially black particles are used as the charged particles 6 having second optical characteristics different from the first optical characteristics. The present invention is not limited to this embodiment, and any particles having mutually different optical characteristics and charging polarities may be used. For example, charged particles substantially having different colors or reflectance may be used.

In this case, the particles visible in the bright display state are preferably formed by materials having light screening ability lower than those of the particles visible in the dark display state. Then, the intensity of reflected light which is to be set to be brighter is further increased, the light is therefore balanced with the other light, and image quality is enhanced.

Furthermore, any of the materials having different optical characteristics and indicating mutually reverse polarities and satisfactory charging characteristics in the dispersion medium may be used as the materials of the charged particles 5, 6 having the first and second optical characteristics. For example, when the white particles are used, inorganic or organic pigments such as $TiO_2$ and $Al_2O_3$, resins, or pigment-containing resins are usable. When the black particles are used, various inorganic or organic pigments, carbon blacks, or resins containing them may be used. Furthermore, a particle diameter of about 0.01 μm to 50 μm is usually usable, and particles having a diameter of about 0.1 μm to 10 μm are preferably used.

On the other hand, any medium may be used as the dispersion medium 4 as long as distribution of the charged particles in the dispersion medium changes in accordance with the voltage. For example, a liquid is used as the dispersion medium in the electric migration display element, a gas is used as the dispersion medium in a toner display, and the present invention is not limited to them.

It is to be noted that when the liquid is used as the dispersion medium 4, a transparent liquid having high insulation property, concretely non-polarity transparent solvents may be used such as iso-paraffin, silicone oil, xylene, and toluene. When the gas is used as the dispersion medium, air, air whose humidity has been managed, or a gas such as nitrogen may be used.

Furthermore, a charge control agent may be added into the dispersion medium and the charged particles. It is to be noted that as the charge control agent, for example, metal complex salt of mono azoic dye, salicylic acid, organic fourth-grade ammonium salt, nigrosin-based compound and the like are usable. Dispersant for preventing aggregation of the charged particles and maintaining dispersed states may be added into the liquid dispersion medium. It is to be noted that as the dispersant, phosphoric polyvalent metal salts such as calcium phosphate and magnesium phosphate, carbonate such as calcium carbonate, other inorganic salts, inorganic oxide, organic polymer materials and the like are usable.

As materials of the display-side and rear-side substrates 1, 2, glass, quartz, or metal such as stainless steel is usable in addition to plastic films such as polyethylene terephthalate (PET), polycarbonate (PC), and polyether sulfone (PES). Here, when the metal is used as the substrate, needless to say, an insulating layer needs to be disposed between the substrate, and a wire and electrode. A substantially transparent material needs to be used in the display-side substrate 1, but a colored substrate of polyimide (PI) or the like, or a metal such as stainless steel may be used in the rear-side substrate.

The partition wall 3 is disposed in such a manner as to surround the respective pixels A, B in order to prevent the movement of the charged particles 5, 6 between the pixels, and the same material as that of the substrate, or a photosensitive resin such as acryl may be used as the material of the partition wall 3. As a forming method, any method may be used. For example, a method in which exposure and wet developing are performed after applying a photosensitive resin layer, a method in which a separately prepared barrier is bonded, a method in which the partition wall is formed by a printing process and the like are usable. A shape of an opening in the partition wall 3 is not especially limited, and examples of the shape include polygonal shapes such as square and rectangular shapes, a circular shape and the like.

As to the material of the reflection layer 9, any material may be used as long as the reflectance of the visible light is high. For example, metals such as silver and aluminum, a multilayered reflection film in which dielectric materials having different refractive indexes are stacked and the like are usable.

As to materials of the first and second electrodes 7, 8, any patternable conductive material may be used, and metals such as titanium (Ti), aluminum (Al), and copper (Cu), oxide such as indium tin oxide (ITO), carbon, silver paste, organic conductive film and the like are usable.

Here, as shown in FIG. 1, when the first electrode 7 is disposed on the display-side substrate, a material having a high transmittance of the visible light needs to be used such as indium tin oxide. When the first electrode 7 is disposed on the rear-side substrate, and utilized as the reflection layer as described later with reference to FIG. 9, a material having a high reflectance is preferably used such as silver (Ag) and aluminum (Al).

It is to be noted that any method may be used as a method of forming the first electrode 7. For example, after forming a conductive film, the film may be patterned using a known photolithography technique, or conductive ink may be printed. Any method may be used as a method of forming the second electrode 8. For example, after forming the second electrode 8 on the rear substrate, the partition wall may be formed, and the second electrode 8 may be formed on the surface of the partition wall formed on the substrate. Furthermore, the partition wall on which the second electrode 8 is formed may be disposed on the substrate, and the second electrode 8 may function also as the partition wall as described later with reference to FIG. 2.

Figure 2:
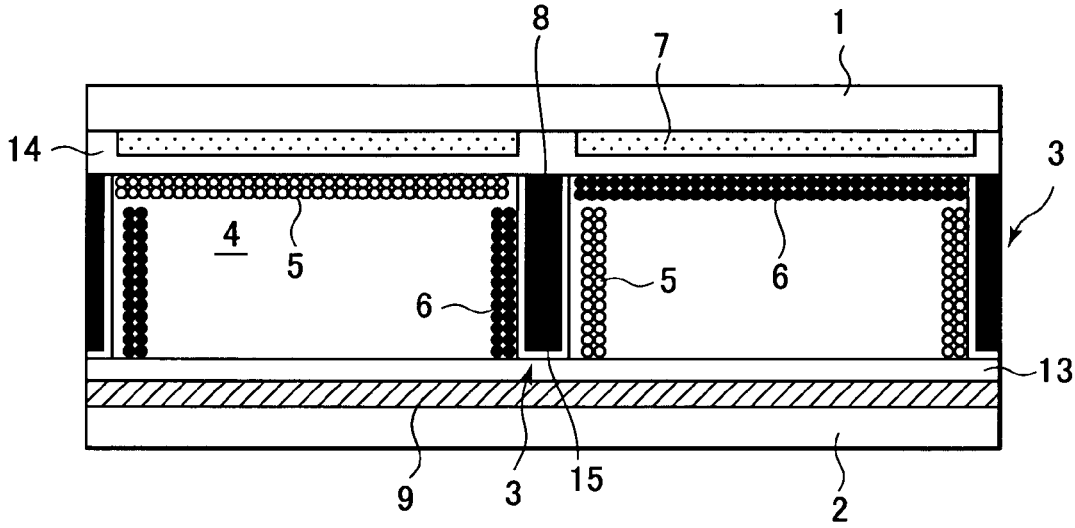
FIG. 2 is a diagram showing another constitution of the electric migration display element.

The insulating layers 13, 14 to cover the first electrode 7 or the second electrode 8, for example, as shown in FIG. 1, or an insulating layer 15 described later with reference to FIG. 2, should be formed by materials such that pinholes are not to be generated in a thin film. Materials such as an amorphous fluorine resin, high-transparency polyimide, and acrylic resin are preferable.

Furthermore, the insulating layer 14, with which the first electrode 7 on the display-side substrate is coated as shown in FIG. 1, is more preferably formed of a material having a high transmittance of visible light. It is to be noted that when conductive particles are used, a charge transport layer may be disposed on the electrode instead of the insulating layer, and electric charges may be injected into the conductive particles from the electrode.

Since the display-side substrate 1, the first electrode 7 on the display-side substrate 1, and the insulating layer 14 for coating the first electrode 7 are formed of materials having a high transmittance of visible light, as described above, most of the light incident onto the display-side substrate 1 reaches the layer of the white particles 5. Thereafter, as described above, a part of the light is reflected, and a part of the light passes through the layer of the white particles 5. The latter part of light is reflected by the reflection layer 9, travels toward the display-side substrate, and passes through the layer of the white particles 5 again to come out to the display surface.

In the present embodiment, the first electrode 7 is disposed on the display-side substrate 1, and the white particles 5 are gathered on the side of the display-side substrate, Then, since the light can be reflected and scattered in the vicinity of the observer 10, bright display is possible with a small particle amount.

Furthermore, when the white particles 5 are moved toward the display-side substrate, the black particles 6 are moved in the vicinity of the second electrode 8. Compared to the conventional case described in FIG. 10, the light is easily reflected by the reflection layer 9, and quantity of the light absorbed by the black particles 6 is reduced to the result in a brighter display state.

Figure 3:
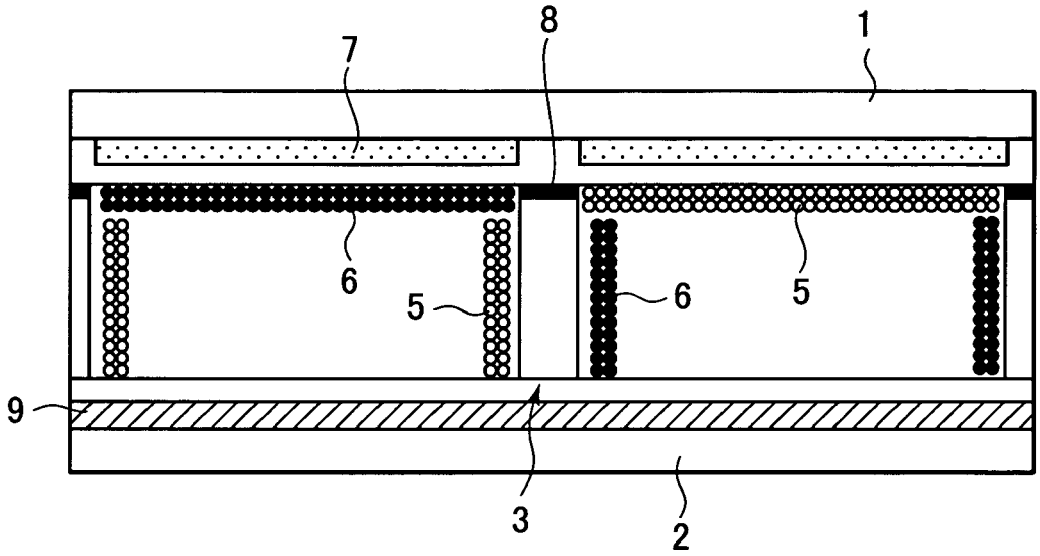
FIG. 3 is a diagram showing another constitution of the electric migration display element.
Figure 4:
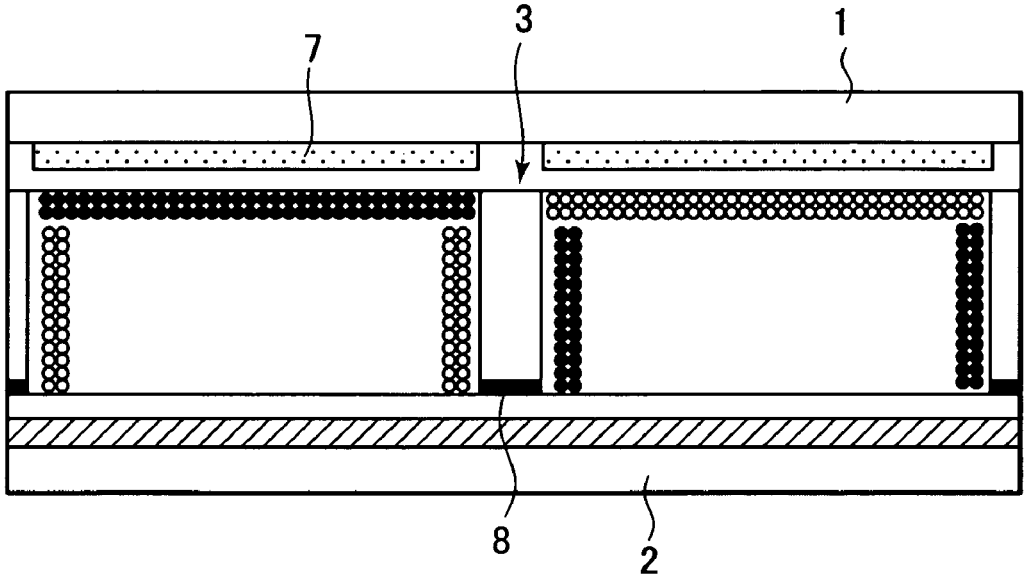
FIG. 4 is a diagram showing another constitution of the electric migration display element.

In the present embodiment, the second electrode 8 is disposed on the side wall of the partition wall 3 as shown in FIG. 1. But the present invention is not limited to this embodiment. For example, as shown in FIGS. 2 and 3, the second electrode may be disposed on the partition wall 3 and the display-side substrate 1. Furthermore, as shown in FIG. 4, the second electrode may be disposed between the partition wall 3 and the rear-side substrate 2, or in one or more of these positions. It is to be noted that in FIG. 2, 15 denotes an insulating layer formed in such a manner as to coat the second electrode 8, and adhering forces between the second electrode 8 and the charged particles 5, 6 are controlled by the insulating layer 15.

Figure 5:
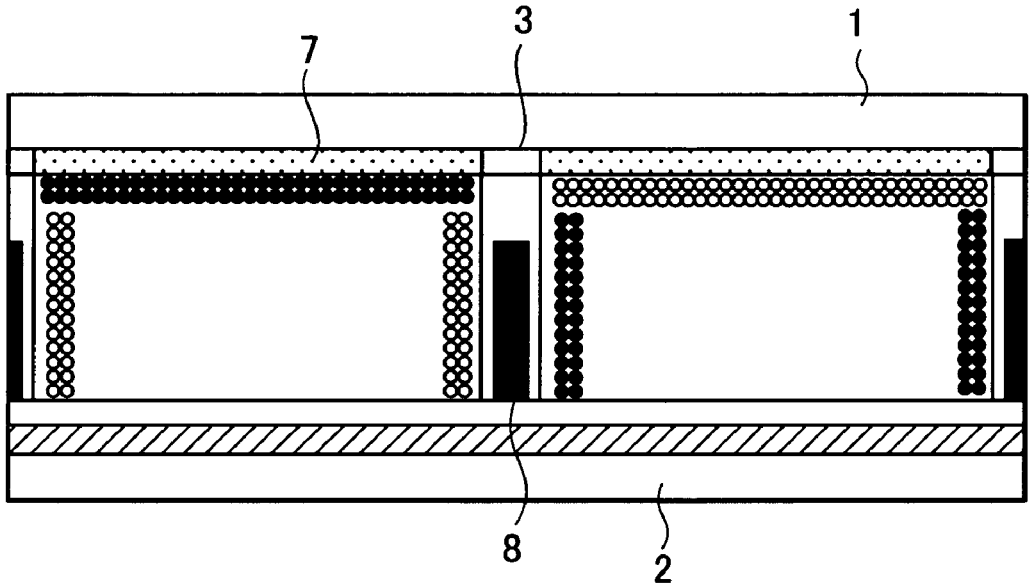
FIG. 5 is a dispersion medium showing another constitution of the electric migration display element.

The first electrode 7 may be present on the surface of the display-side substrate, or a part of the first electrode may be present inside the partition wall 3 as shown in FIG. 5. Furthermore, the first electrode may be present on the display-side substrate 1 or inside the substrate via the partition wall 3 and another layer.

In FIG. 1, the pixels A, B are independently driven. At least one of the first and second electrodes 7, 8 needs to be divided for each of the pixels A, B, and the voltage needs to be independently applied. For example, in the constitution shown in FIG. 1, the second electrode 8 is divided for each pixel as described above, each electrode is connected to a switching element (not shown), and the first electrode 7 is driven in common to the respective pixels.

It is to be noted that additionally, for example, as shown in FIG. 5, the first electrode 7 may be divided for each pixel, the second electrode 8 may be driven in common to the respective pixels, or both the first and second electrodes 7, 8 may be divided for each pixel. When a specific pattern is constantly displayed, at least one of the first and second electrodes 7, 8 may be divided for each portion to be separately driven.

Figure 6A:
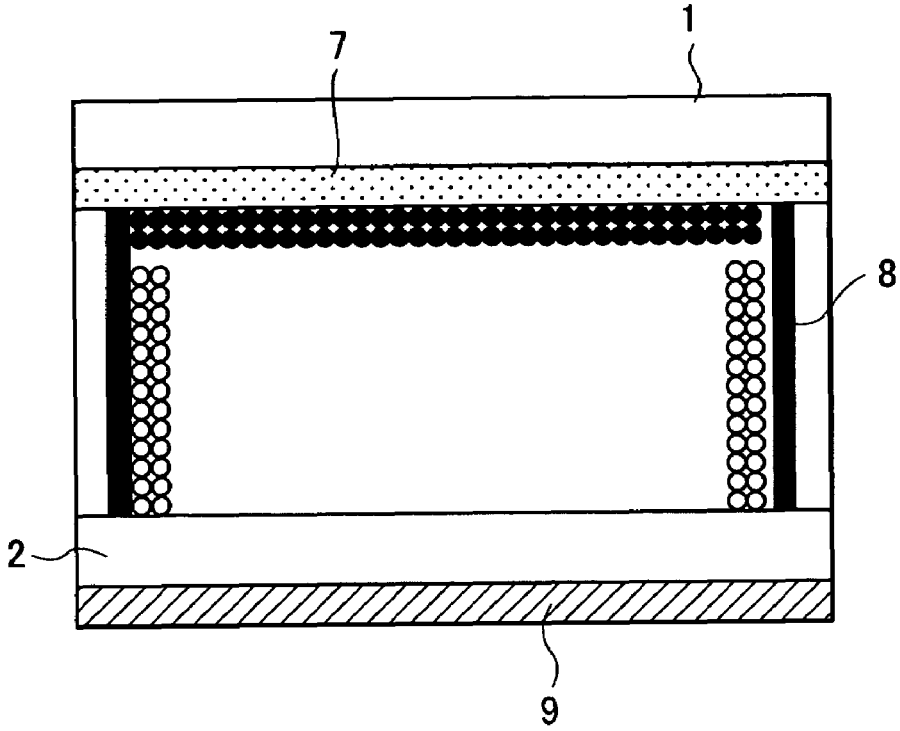
FIGS. 6A and 6B are diagrams showing another constitution of the electric migration display element.
Figure 6B:
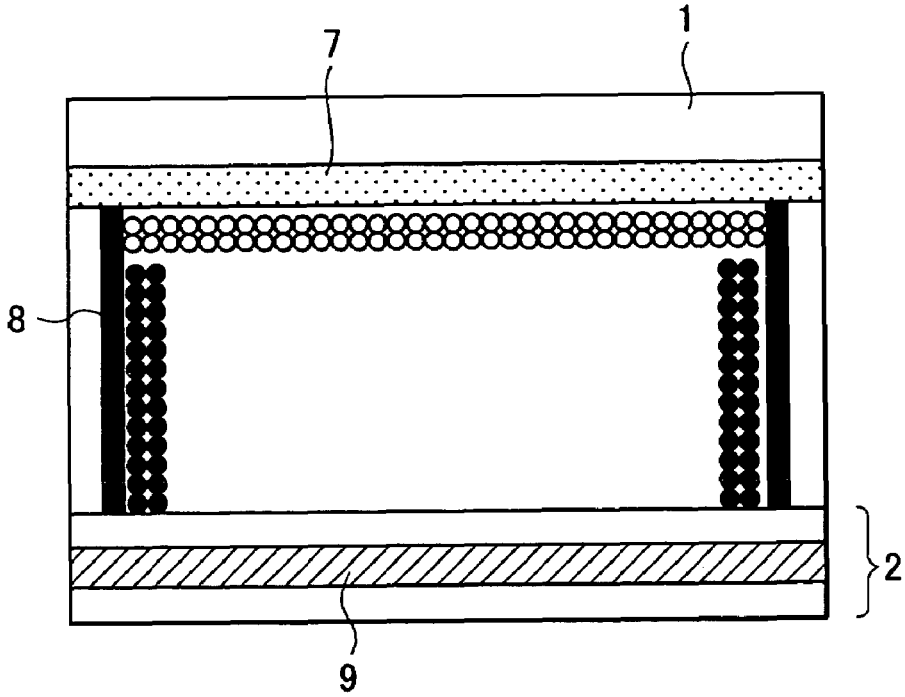

In FIG. 1, the reflection layer 9 is disposed on the rear-side substrate surface facing the display-side substrate 1. The reflection layer may be disposed on the other surface away from the display-side substrate 1 as shown in FIG. 6A, or inside the substrate as shown in FIG. 6B. Furthermore, the reflection layer may be disposed on the rear-side substrate via another layer. Additionally, a protective layer may be disposed on the reflection layer 9.

Figure 7A:
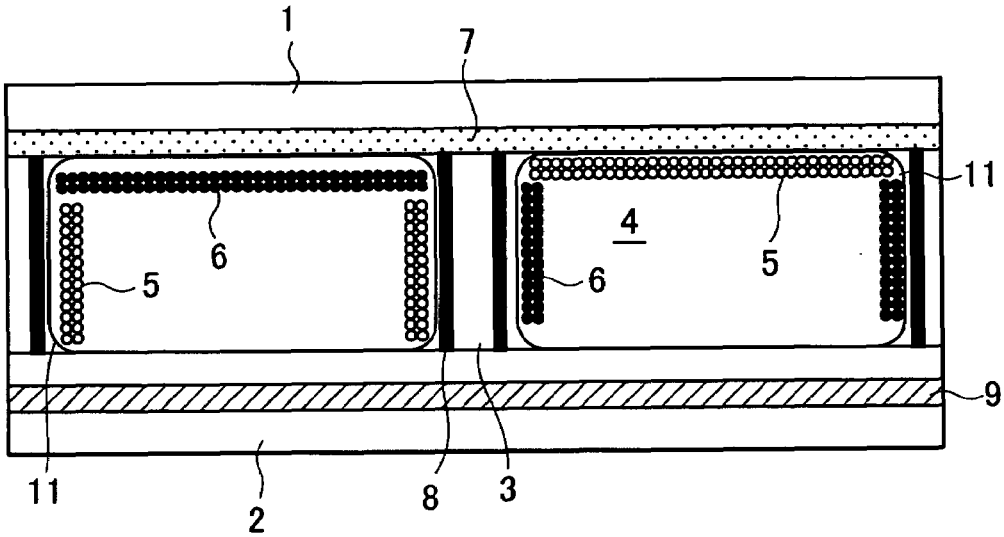
FIGS. 7A and 7B are diagrams showing another constitution of the electric migration display element.
Figure 7B:
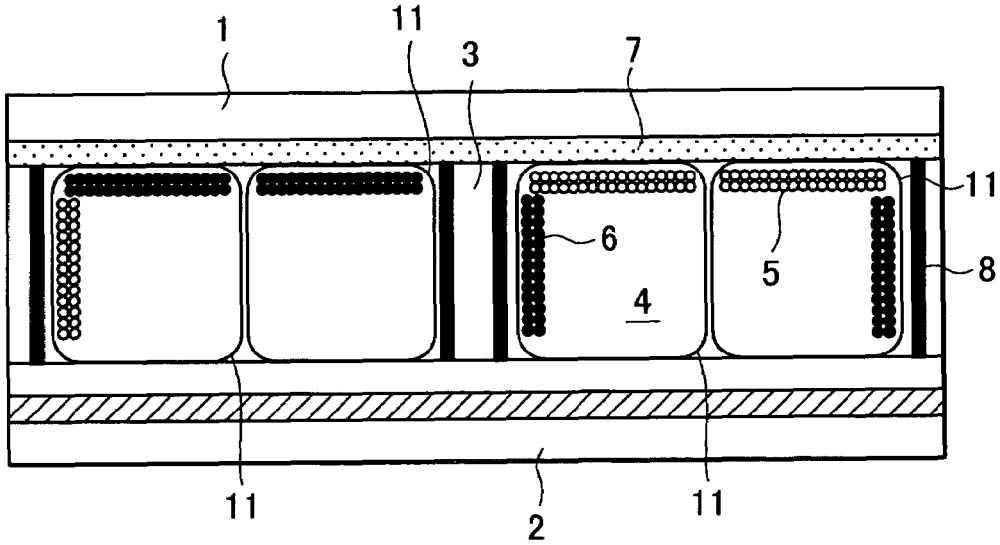

The charged particles 5, 6 and the dispersion medium 4 may be packed in a microcapsule, and the microcapsule may be contained in a space corresponding to the pixel. It is to be noted that in this case, a microcapsule 11 in which the charged particles 5, 6 and dispersion medium 4 are packed may be included in one pixel as shown in FIG. 7A, or a plurality of microcapsules may be included in one pixel as shown in FIG. 7B.

When charged migration particles are confined in the microcapsule to constitute a space constituting the pixel, a boundary member defining the space is a wall member of the microcapsule. In this case, first and second boundary members correspond to upper and lower halves of a capsule wall face, respectively. The wall face of the capsule upper half which corresponds to the first boundary member comprises a transparent member. Electrodes are preferably attached to outer wall faces and side faces of the upper or lower half of the capsule.

Here, known techniques such as an interface polymerization process, in-situ polymerization process, and core salvation process are usable in manufacturing the microcapsule 11 including the charged particles 5, 6 and dispersion medium 4, but the present invention is not limited to them. Although a method of disposing the microcapsule 11 is not especially limited, an ink jet system nozzle, electrostatic transfer process or the like is usable.

Furthermore, for a purpose of preventing a positional shift of the microcapsule 11 disposed on the substrate, a gap in the microcapsule 11 is impregnated with a light-transmitting resin binder, and the microcapsule may be fixed onto the substrate. It is to be noted that examples of the light-transmitting resin binder include water-soluble polymer, and, for example, polyvinyl alcohol, polyurethane, polyester, acrylic resin, silicone resin and the like are usable.

Figure 8:
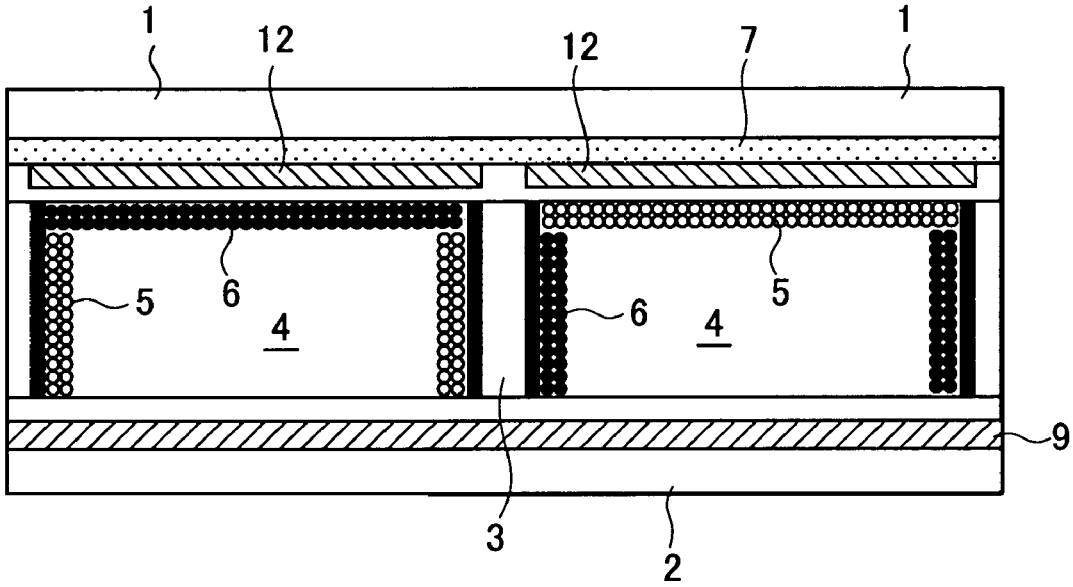
FIG. 8 is a diagram showing another constitution of the electric migration display element.

Moreover, as shown in FIG. 8, for example, when a color filter 12 is disposed on the display-side substrate 1, color display is possible. It is to be noted that in the drawing, the color filter 12 is disposed in the display-side substrate 1. The color filter 12 may be disposed in one or more positions on the display-side substrate 1, or between the display-side substrate 1 and the dispersion medium 4. A layer for protecting the color filter 12 may be disposed. Furthermore, when pixels comprising red, blue, green color filters 12 are combined, or pixels comprising cyan, magenta, yellow color filters are combined, full-color display is possible.

Next, embodiments of the present invention will be described.

Embodiment 1

In the present embodiment, an electric migration display device comprising an electric migration display element shown in FIG. 1 will be prepared by the following preparation method.

It is to be noted that in the display element prepared in the present embodiment, 200×200 pixels are assumed, and one pixel has a size of 120 μm×120 μm. Each pixel is surrounded by a partition wall. A structure of the partition wall has a width of 8 μm and a height of 20 μm. A first electrode is disposed on a display-side substrate, and is common to the respective pixels. A second electrode is positioned on the side face of the partition wall, that is, on the face of the partition wall in the vicinity of the dispersion medium.

First, a glass plate having a thickness of 1.1 mm is used as a rear-side substrate 2, and a switching element (not shown), or a wire (not shown), an IC (not shown) or the like required for driving is formed on the rear-side substrate. Next, the surface of the rear-side substrate 2 is coated with an insulating layer (not shown), and a reflection layer 9. Thereafter, a part of the insulating layer or the reflection layer 9 is removed to thereby prepare a contact hole. It is to be noted that aluminum is used as a material of the reflection layer 9.

Next, an insulating layer 13 is disposed on the reflection layer 9 excluding a contact hole portion. Furthermore, a partition wall 3 is disposed around the pixel. Thereafter, the whole surface is coated with a film of titanium, and patterned to thereby form a second electrode 8 on the side face of the partition wall 3. Moreover, a wire (not shown) is disposed to connect the second electrode 8 to a switching element (not shown) via the contact hole. It is to be noted that the second electrode 8 is divided for each of the pixels A, B, and a voltage may be independently applied to the electrode via the switching element.

Next, the second electrode 8 is coated with an insulating layer (not shown), and thereafter the respective pixels A, B are charged with a liquid dispersion medium 4 and two types of charged particles 5, 6. It is to be noted that an acrylic resin is used as an insulating layer, isoparaffin (tradename: Isoper, manufactured by Exxon Co.) is used as the liquid dispersion medium 4, $TiO_2$ coated with polymer is used as the first charged particles 5, and resin particles containing carbon black are used as the second charged particles 6. A charging control agent and dispersant are added to the liquid dispersion medium 4.

On the other hand, a first electrode 7 and an insulating layer 14 are separately formed on a display-side substrate 1. It is to be noted that a PET film having a thickness of 100 μm is used as the display-side substrate 1, ITO is used as the first electrode 7, and an acrylic resin is used as the insulating layer 14. Moreover, the display-side substrate 1 is disposed on the partition wall 3, voltage application means (not shown) is connected to the first and second electrodes 7, 8, and an electric migration display device is obtained.

In an electric migration display element prepared by the above-described method, white first charged particles 5 are charged to be negative, and black second charged particles 6 are charged to be positive in the liquid dispersion medium 4. Therefore, when 0 V is applied to the first electrode 7, and a positive voltage is applied to the second electrode 8, the black second charged particles 6 gather in the vicinity of the first electrode 7, the white first charged particles 5 gather in the vicinity of the second electrode 8, and therefore black display is possible. Conversely, when 0 V is applied to the first electrode 7, and a negative voltage is applied to the second electrode 8, the black second charged particles 6 gather in the vicinity of the second electrode 8, the white first charged particles 5 gather in the vicinity of the first electrode 7, and therefore white display is possible.

Moreover, according to the present embodiment, the light which has passed though the layer of the white first charged particles 5 is reflected by the reflection layer 9, passes through the layer of the white first charged particles 5 again, and emerges from the layer. Therefore, it is possible to obtain an electric migration display device in which brighter white display is possible.

Embodiment 2

Figure 9:
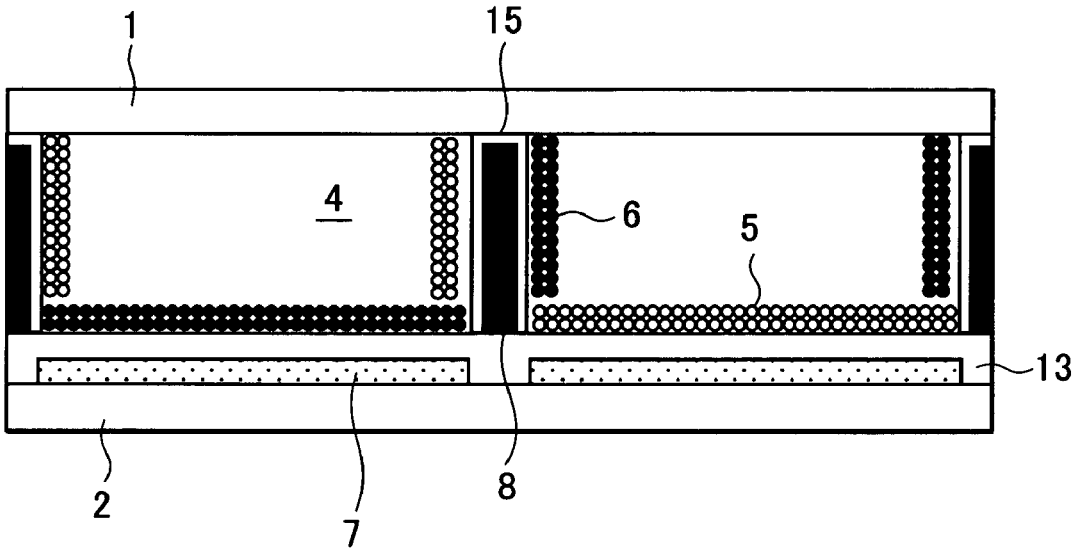
FIG. 9 is a diagram showing another constitution of the electric migration display element.

In the present embodiment, an electric migration display device comprising an electric migration display element shown in FIG. 9 will be prepared. As a preparation method, first a switching element (not shown), or a wire (not shown), an IC or the like required for driving is formed on a rear-side substrate 2 in the same manner as in Embodiment 1.

Next, an insulating layer (not shown) in which a contact hole is disposed is formed, an aluminum film is formed and patterned, and a first electrode 7 functioning also as a reflection layer is formed. Here, the first electrode 7 is divided for each pixel, and each electrode is connected to the switching element via the contact hole. It is to be noted that the first electrode 7 has a square shape having each 100 μm side.

Next, the first electrode 7 is coated with an insulating layer 13 formed of an acrylic resin. Thereafter, a second electrode 8 functioning also as a partition wall is formed on the insulating layer 13 in such a manner as to surround the pixel using a known plating technique. Here, in the present embodiment, copper is used as the second electrode 8, and the second electrode has a lattice shape having a pitch of 120 μm and a height of 20 μm.

Next, the second electrode 8 is coated with an insulating layer 15 formed of the acrylic resin. Thereafter, an electric migration display device is obtained in the same manner as in Embodiment 1. In the electric migration display device obtained by the present embodiment, when 0 V is applied to the second electrode, and a voltage polarity of the first electrode is changed to thereby change particle distribution, display can be switched. The present embodiment has an effect similar to that of Embodiment 1.

Embodiment 3

In the present embodiment, an electric migration display device comprising an electric migration display element shown in FIG. 7B will be prepared. As a preparation method, a second electrode 8 is formed on a rear-side substrate 2 in the same manner as in Embodiment 1. Thereafter, a microcapsule containing a liquid dispersion medium 4 and first and second charged particles 5, 6 is prepared by an in-situ polymerization process. It is to be noted that a film material is urea-formaldehyde resin.

Next, a microcapsule 11 is disposed on the rear-side substrate 2 using an ink jet system nozzle, further a gap in the microcapsule 11 is impregnated with a light-transmitting resin binder (polyvinyl alcohol) (not shown), and the microcapsule is fixed onto the rear-side substrate.

Next, a first electrode 7 is formed on a display-side substrate 1, the display-side substrate 1 is disposed on the microcapsule 11 and a partition wall 3, voltage application means (not shown) is connected to first and second electrodes 7, 8, and the electric migration display device is obtained. The electric migration display device prepared by the present embodiment has an effect similar to that of Embodiment 1.

Embodiment 4

In the present embodiment, a second electrode is formed on a rear-side substrate, and an insulating layer with which the second electrode is coated is formed in the same manner as in Embodiment 1. Additionally, a height of a partition wall is set to 100 μm in the present embodiment. Next, a mixture of white first charged particles 5, a charge control agent, and black second charged particles 6 is disposed in an opening of the partition wall on the rear-side substrate.

Thereafter, in the same manner as in Embodiment 1, a display-side substrate comprising a first electrode is disposed and fixed onto the partition wall, first and second electrodes are connected to voltage application means (not shown), and the electric migration display device is obtained. In the display device prepared by the present embodiment, the first electrode is connected to 0 V, a voltage of ±150 V is applied to the second electrode, and accordingly white/black display is possible. Moreover, the device has an effect that reflectance increases by a reflection layer present on the rear-side substrate at a white display time.

Embodiment 5

In the present embodiment, an electric migration display device shown in FIG. 6A is obtained in the same manner as in Embodiment 1 except that a reflection layer 9 is formed on the surface of a rear-side substrate 2 on an opposite side of a display-side substrate 1. The electric migration display device prepared by the present embodiment has an effect similar to that of Embodiment 1.

It is to be noted that it has been described above that the reflection layer 9 is used as a reflection portion which reflects leak light from charged particles, but the present invention is not limited to this case, and a reflection plate may be used as the reflection portion. Moreover, even when the reflection plate is used as the reflection portion, the leak light is scattered during passing through a charged particles layer. Therefore, since the reflection plate does not require any special diffusion property or directivity, a usual low-cost regular reflection plate may be used.

This application claims priority from Japanese Patent Application No.2004-081695 filed Mar. 19, 2004, which is hereby incorporated by reference herein.

What is claimed is:

1. A display device comprising:

a transparent first boundary member having a display face side;

a second boundary member disposed at a predetermined distance from said first boundary member;

partition walls disposed between said first and second boundary members and forming an enclosed gap therebetween;

two types of charged particles and a dispersion medium disposed in the gap between said first and second boundary members, said two types of charging particles having different charging polarities and optical characteristics;

first and second electrodes to which voltages are applied and which move the charged particles in the gap to form a display, said first electrode disposed proximate to said first or second boundary members and said second electrode disposed proximate to said partition walls; and a light reflection member on said second boundary member for reflecting light to said first boundary member.

2. The display device according to claim 1, wherein display is performed using states in which only one of two types of charged particles is visually recognized and in which both of them are visually recognized in a mixed manner as seen from a display face.

3. The display device according to claim 1, wherein one of said two types of charged particles is white, and the other is black.

4. The display device according to claim 1, wherein light screening ratios of said two types of charged particles are different.

5. The display device according to claim 4, further comprising a color filter disposed on said first boundary member.

6. The display device according to claim 1, further comprising a microcapsule disposed in the gap and containing said charged particles and said dispersion medium.

7. The display device according to claim 6, wherein a plurality of said microcapsules are disposed in the gap.

8. A display device comprising:

a transparent first boundary member having a display side;

a second boundary member disposed at a predetermined distance from said first boundary member;

partition walls disposed between said first and second boundary members and forming an enclosed gap therebetween;

two types of charged particles and a dispersion medium disposed in the gap between said first and second boundary members, said two types of charging particles having different charging polarities and optical characteristics;

first and second electrodes to which voltages are applied and which move the charged particles in the gap to form a display; and reflection means for reflecting transmitted light to the display side of said first boundary member.

9. The display device according to claim 8, wherein display is performed using states in which only one of said two types of charged particles is visually recognized and in which both of them are visually recognized in a mixed manner as seen from the display side.

10. The display device according to claim 8, wherein one of said two types of charged particles is white, and the other is black.

11. The display device according to claim 8, wherein light screening ratios of said two types of charged particles are different.

12. The display device according to claim 11, further comprising a color filter disposed on said boundary member.

13. The display device according to claim 8, further comprising a microcapsule disposed in the gap and containing said charged particles and said dispersion medium.

14. The display device according to claim 13, wherein a plurality of said microcapsules are disposed in the gap.

15. A display device comprising:

a transparent first boundary member having a display side;

a second boundary member disposed at a predetermined distance from said first boundary member;

partition walls disposed between said first and second boundary members and forming an enclosed gap therebetween;

two types of charged particles and a dispersion medium disposed in the gap between said first and second boundary members, said two types of changing particles having different charging polarities and optical characteristics;

charged particle moving means for moving the charged particles in the gap to form a display; and a light reflection member on said second boundary member for reflecting light to said first boundary member.

16. The display device according to claim 15, wherein display is performed using states in which only one of said two types of charged particles is visually recognized and in which both of them are visually recognized in a mixed manner as seen from the display side.

17. The display device according to claim 15, wherein one of said two types of charged particles is white, and the other is black.

18. The display device according to claim 15, wherein light screening ratios of said two types of charged particles are different.

19. The display device according to claim 18, further comprising a color filter disposed on said boundary member.

20. The display device according to claim 15, further comprising a microcapsule disposed in the gap and containing said charged particles and said dispersion medium.

21. The display device according to claim 20, wherein a plurality of said microcapsules are disposed in the gap.

22. The display device according to claim 15, wherein said charged particle moving means includes a first electrode disposed proximate to said first or second boundary member and a second electrode disposed proximate to said partition walls.

* * * * *

UNITED STATES PATENT AND TRADEMARK OFFICE

CERTIFICATE OF CORRECTION

PATENT NO. : 7,352,354 B2
APPLICATION NO. : 11/081741
DATED : April 1, 2008
INVENTOR(S) : Koichi Ishige It is certified that error appears in the above-identified patent and that said Letters Patent is hereby corrected as shown below:

On the Title Page
Item [57] ABSTRACT:

Line 8, “changing” should read --charging--.
Line 14, “portion” should read --partition--.

COLUMN 2:

Line 49, “changing” should read --charging--.

COLUMN 3:

Line 32, “dispersion medium” should read --diagram--.

COLUMN 13:

Line 29, “changing” should read --charging--.

Signed and Sealed this

Tenth Day of February, 2009

John Doll

JOHN DOLL
*Acting Director of the United States Patent and Trademark Office*